US009674920B2

(12) United States Patent
Chiang et al.

(10) Patent No.: US 9,674,920 B2
(45) Date of Patent: Jun. 6, 2017

(54) ILLUMINATION SYSTEM AND METHOD FOR DEVELOPING TARGET VISUAL PERCEPTION OF AN OBJECT

(71) Applicant: Industrial Technology Research Institute, Hsinchu (TW)

(72) Inventors: Ya-Hui Chiang, Hsinchu County (TW); Shih-Yi Wen, Taipei (TW); Chia-Fen Hsieh, Hsinchu County (TW); Chun-Hsing Lee, Hsinchu (TW); Chien-Chun Lu, New Taipei (TW); Han-Kuei Fu, New Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 14/955,057

(22) Filed: Dec. 1, 2015

(65) Prior Publication Data

US 2016/0157321 A1 Jun. 2, 2016

Related U.S. Application Data

(60) Provisional application No. 62/085,657, filed on Dec. 1, 2014.

(30) Foreign Application Priority Data

Nov. 20, 2015 (TW) ..... 104138408 A

(51) Int. Cl.
*H05B 37/02* (2006.01)
*H05B 33/08* (2006.01)

(52) U.S. Cl.
CPC ..... *H05B 33/0872* (2013.01); *H05B 33/086* (2013.01); *H05B 33/0869* (2013.01)

(58) Field of Classification Search
CPC .. F21Y 2101/02; F21Y 2115/10; G09F 21/02; H05B 37/029; H05B 33/0815;
(Continued)

(56) References Cited

U.S. PATENT DOCUMENTS 7,344,279 B2 * 3/2008 Mueller ..... F21S 48/325 362/240
7,391,499 B2 * 6/2008 Schmidt ..... G03F 7/70291 355/53
(Continued)

FOREIGN PATENT DOCUMENTS

CN 102281680 A 12/2011
CN 102901714 1/2013
(Continued)

OTHER PUBLICATIONS

"Office Action of Taiwan Counterpart Application", issued on Aug. 23, 2016, p. 1-p. 7.

*Primary Examiner* — Haissa Philogene
(74) *Attorney, Agent, or Firm* — Jianq Chyun IP Office

(57) ABSTRACT

An illumination system that includes a light source device and an algorithm unit is provided. The algorithm unit is coupled to the light source device and outputs a control signal to the light source device according to a reflection spectrum of an object, a visual color matching function, a visual preference correction function, or a combination of the above. The light source device outputs an illumination beam according to the control signal, so as to develop target visual perception of the object while the object is being irradiated by the illumination beam. A method for developing target visual perception of an object is also provided.

19 Claims, 2 Drawing Sheets

(58) Field of Classification Search
CPC H05B 37/02; H05B 37/0218; H05B 33/0803; F21K 9/00; F21V 19/001
USPC ..... 362/231, 236, 240, 294, 373, 800, 227; 315/153, 312, 297, 307
See application file for complete search history.

(56) References Cited

U.S. PATENT DOCUMENTS

| | | | | |
|---|---|---|---|---|
| 7,825,996 | B2 * | 11/2010 | Yamada | G02B 27/017 345/8 |
| 8,872,923 | B2 | 10/2014 | Gottwals et al. | |
| 8,976,252 | B2 | 3/2015 | Koh et al. | |
| 9,060,409 | B2 | 6/2015 | Bowers et al. | |
| 9,222,882 | B2 * | 12/2015 | Hirabayashi | G01N 21/57 |
| 2010/0097406 | A1 | 4/2010 | Zulch | |
| 2013/0249410 | A1 | 9/2013 | Thompson | |
| 2015/0035440 | A1 * | 2/2015 | Spero | B60Q 1/04 315/153 |

FOREIGN PATENT DOCUMENTS

| | | | |
|---|---|---|---|
| TW | 201022980 | A | 6/2010 |
| TW | 201421183 | | 6/2014 |
| TW | 201441589 | A | 11/2014 |
| TW | I476383 | | 3/2015 |
| WO | 2014166930 | A1 | 10/2014 |

* cited by examiner

ILLUMINATION SYSTEM AND METHOD FOR DEVELOPING TARGET VISUAL PERCEPTION OF AN OBJECT

CROSS-REFERENCE TO RELATED APPLICATION

This application claims the priority benefits of U.S. provisional application Ser. No. 62/085,657, filed on Dec. 1, 2014, and Taiwan application serial no. 104138408, filed on Nov. 20, 2015. The entirety of each of the above-mentioned patent application is hereby incorporated by reference herein and made a part of this specification.

TECHNICAL FIELD

The disclosure relates to an illumination system and a method for developing target visual perception of an object.

BACKGROUND

Spectra of different light beams have different hues. Therefore, an object develops different visual perceptions while the object is being irradiated by light sources with different spectra. For instance, while the object is being irradiated by a light beam with a reddish spectrum, the light beam casts a warm hue on the object; while the object is being irradiated by a light beam with a blueish spectrum, the light beam casts a cold hue on the object. In terms of commercial applications, the visual perception developed by the object poses an impact on consumers' desires to shop. The spectrum of the light source, if properly modulated according to design demands, can create experiences which influence consumers' mood as well as stimulate the shopping behavior.

SUMMARY

The disclosure provides an illumination system that allows an object to develop target visual perception while the object is being irradiated by an illumination beam. The disclosure also provides a method for developing target visual perception of an object.

In an exemplary embodiment, an illumination system that includes a light source device and an algorithm unit is provided. The algorithm unit is coupled to the light source device and outputs a control signal to the light source device according to a reflection spectrum of an object, a visual color matching function, a visual preference correction function, or a combination thereof. The light source device outputs an illumination beam according to the control signal, so as to develop target visual perception of the object while the object is being irradiated by the illumination beam.

In another exemplary embodiment, a method for developing target visual perception of an object includes following steps. A control signal is output by an algorithm unit to a light source device according to a reflection spectrum of the object, a visual color matching function, a visual preference correction function, or a combination thereof. An illumination beam is output by the light source device according to the control signal, such that the object develops target visual perception while the object is being irradiated by the illumination beam.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1:
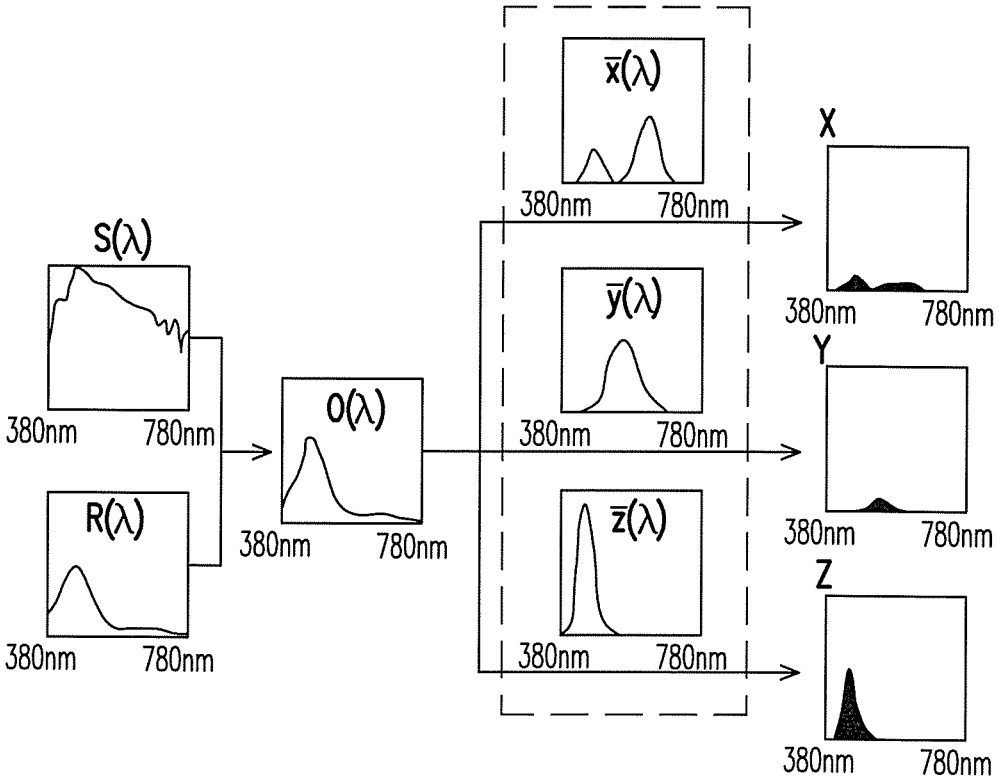
FIG. 1 illustrates an impact of a light source and a visual color matching function on a color of an object visible to human eyes.

FIG. 1 illustrates an impact of a light source and a visual color matching function on a color of an object visible to human eyes. The horizontal coordinate of each block in FIG. 1 represents a wavelength falling within a range from 380 nm to 780 nm. With reference to FIG. 1 and equations (1)-(4), while an object is being irradiated by a light source device, the spectrum $O(\lambda)$ reflected by the object is obtained by multiplying a spectrum $S(\lambda)$ of an emitted light beam from the light source device by a reflection spectrum $R(\lambda)$ of the object and integrating the product of the spectrum $S(\lambda)$ and the reflection spectrum $R(\lambda)$. Human eyes differ in their sensitivities to different wavelengths of light beams, e.g., short wavelengths (420 nm to 440 nm), middle wavelengths (530 nm to 540 nm), and long wavelengths (560 nm to 580 nm); hence, the color (represented by tristimulus values X, Y, and Z) of the object visible to human eyes is the result obtained by multiplying visual color matching functions $\bar{x}(\lambda)$, $\bar{y}(\lambda)$, and $\bar{z}(\lambda)$ (i.e., the blocks surrounded by dotted lines) by the spectrum $O(\lambda)$ reflected by the object while the object is being irradiated by the light source device and integrating the product of the visual color matching functions $\bar{x}(\lambda)$, $\bar{y}(\lambda)$, and $\bar{z}(\lambda)$ and the spectrum $O(\lambda)$. In the equations 2-3, k is a constant. Namely, the color of the object visible to the human eyes may differ from the true color of the object while the object is being irradiated by the light source device. Besides, human visual perception of different colors may alter due to visual preferences or subjective judgments; for instance, the object in blue may create a cooling effect. In view of the above, the disclosure provides an illumination system and a method for developing target visual perception of an object. The method is applicable to the illumination system, and the illumination beam output by the light source device of the illumination system is modulated according to the aforesaid factors relevant to visual perception, e.g., the reflection spectrum of the object, the visual color matching function, and the visual preferences, such that the object can develop target visual perception while the object is being irradiated by the illumination beam.

$$O(\lambda) = \int_{380}^{780} S(\lambda)R(\lambda)d\lambda \tag{1}$$

-continued $$X = k\int_{380}^{780} O(\lambda)\bar{x}(\lambda)d\lambda \quad (2)$$

$$Y = k\int_{380}^{780} O(\lambda)\bar{y}(\lambda)d\lambda \quad (3)$$

$$Z = k\int_{380}^{780} O(\lambda)z(\lambda)d\lambda \quad (4)$$

Figure 2:
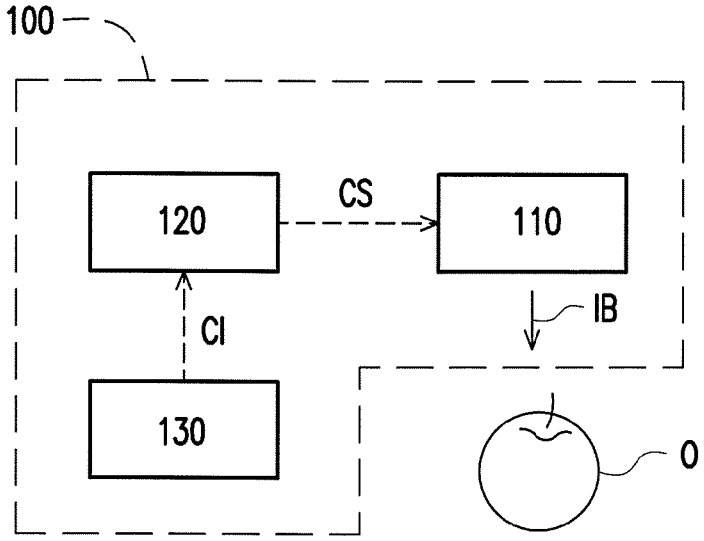
FIG. 2 is a schematic diagram illustrating an illumination system according to an exemplary embodiment of the disclosure.
Figure 3:
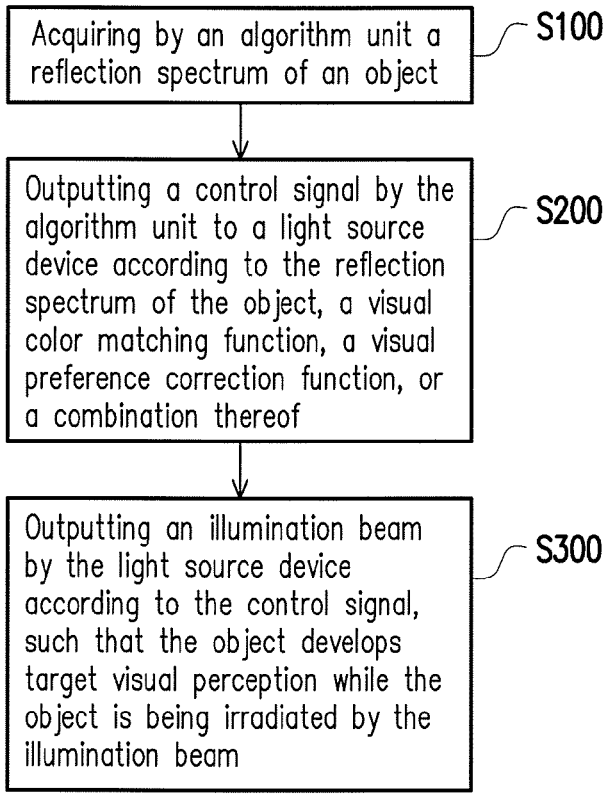
FIG. 3 is a schematic flow chart illustrating a method for developing target visual perception of an object according to an exemplary embodiment of the disclosure.

FIG. 2 is a schematic diagram illustrating an illumination system according to an exemplary embodiment of the disclosure. FIG. 3 is a schematic flow chart illustrating a method for developing target visual perception of an object according to an exemplary embodiment of the disclosure. With reference to FIG. 2, an illumination system 100 includes a light source device 110 and an algorithm unit 120. The light source device 110 is adapted for providing an illumination beam IB to irradiate an object O. For instance, the light source device 110 may include a plurality of light emitting elements (not shown). The light emitting elements may be light emitting diodes (LED), which should however not be construed as a limitation to the disclosure. Besides, the light emitting elements have different light emitting spectra. Specifically, the light emitting spectra of the light emitting elements may be composed of at least two different wavelengths, and the intensity of the light beams with any of the wavelengths can be individually modulated. In the present exemplary embodiment, the light emitting spectra of the light emitting elements may be composed of red, green, and blue light emitting spectra, and the light emitting elements include red LED, green LED, and blue LED, which should however not be construed as limitations to the disclosure. In another embodiment of the disclosure, the light emitting spectra of the light emitting elements may be composed of four different wavelengths, for instance.

The algorithm unit 120 is coupled to the light source device 110 and adapted for outputting a control signal CS to the light source device 110, such that the light source device 110 modulates intensities of emitted light beams with different wavelengths (colors) from the light emitting elements according to the control signal CS. The algorithm unit 120 may transmit the control signal CS to the light source device 110 through a cable or through a wireless connection. In an exemplary embodiment, the algorithm unit 120 may be installed in the light source device 110, a mobile device, a gateway, or a cloud system.

With reference to FIG. 2 and FIG. 3, a method for developing target visual perception of the object O may include following steps. In step S200, the control signal CS is output by the algorithm unit 120 to the light source device 110 according to a reflection spectrum of the object O, a visual color matching function, a visual preference correction function, or a combination thereof. In step 300, the illumination beam IB is output by the light source device 110 according to the control signal CS, such that the object O develops target visual perception while the object O is being irradiated by the illumination beam IB.

To be specific, the algorithm unit 120 modulates the spectrum of the illumination beam IB from the light source device 110 according to one, two, or all of the aforesaid factors relevant to visual perception (i.e., the reflection spectrum of the object, the visual color matching function, and the visual preferences). For instance, if it is intended to render the visible color of the object O close to the true color of the object O, the algorithm unit 120 may correct the control signal CS according to the reflection spectrum of the object O and the visual color matching function, such that the corrected reflection spectrum is sufficient to compensate the impact of the visual color matching function on visual color perception. In the disclosure, the visual color matching function can be visual color matching functions $\bar{x}(\lambda)$, $\bar{y}(\lambda)$, and $\bar{z}(\lambda)$ corresponding to CIE XYZ color space. Alternatively, the visual color matching function can be visual color matching functions $\bar{r}(\lambda)$, $\bar{g}(\lambda)$, and $\bar{b}(\lambda)$ corresponding to CIE RGB color space. If the visual perception developed by the object O is to be further corrected while the object O is being irradiated by the illumination beam IB, e.g., if at least one of the value, the hue, and the chroma of the object O is to be adjusted, the algorithm unit 120 may further modulate the spectrum of the illumination beam IB from the light source device 110 according to the visual preference correction function.

Specifically, the visual preference correction function indicates the target visual perception. If it is intended to develop a colorful visual perception (i.e., high saturation) of the object O while the object O is being irradiated by the illumination beam IB, the algorithm unit 120 may correct the control signal CS according to the visual preference correction function, so as to modulate the intensity of the illumination beam IB; thereby, a value of the object O is within a range from N4 to N6 defined by a Munsell Color System while the object O is being irradiated by the illumination beam IB. In this scenario, the visual preference correction function may include a calculation matrix converting the reflection spectrum into a CIE La*b* color space and a calculation matrix adjusting the value (L) while the color coordinate (a*, b*) remains unchanged. Through increasing the intensities of light beams with different wavelengths from the light emitting elements, the intensity of the illumination beam IB can be modulated.

In another exemplary embodiment, the visual preference correction function may include a plurality of transformation matrices. Each of the transformation matrices is adapted for modulating the spectrum of the illumination beam IB, so as to correct at least one of a value, a hue, and a chroma of the object O while the object O is being irradiated by the illumination beam IB and develop the target visual perception. Given the same spectrum of light beams and the same color of the object, different people may have different visual perceptions, e.g., the feeling of warmth, comfort, coolness, terror, and so on. Given different colors of the object and different spectrums of light beams, the transformation matrices may be created by analyzing and calculating visual perceptions of multiple groups of people during experiments, and each of the transformation matrices has independent weighted values corresponding to one of the visual perceptions based on the results of the human factor experiments. The algorithm unit 120 may select at least one target transformation matrix from the transformation matrices according to a visual configuration condition (exemplarily including visual perception and the weighted value). Besides, the algorithm unit 120 outputs the corresponding control signal CS according to the at least one target transformation matrix, so as to modulate the spectrum of the illumination beam IB and thereby correct at least one of the value, the hue, and the chroma of the object O while the object O is being irradiated by the illumination beam IB and develop the target visual perception.

Specifically, the visual configuration condition indicates the target visual perception. Each of the transformation matrices has a weighted value corresponding to the target visual perception, and the weighted value of the at least one target transformation matrix corresponding to the target visual perception is greater than 50%. For instance, if the visual configuration condition is to display a feeling of comfort and coolness by the object O irradiated by the illumination beam IB, and the weighted value of the target transformation matrix corresponding to the feeling of comfort and coolness is required to be greater than 50%, the algorithm unit 120 can select one or more target transformation matrices from the transformation matrices according to the visual configuration condition, and the algorithm unit 120 may either choose one of the target transformation matrices as the optimal target transformation matrix or feed all of the target transformation matrices back to the light source device 110 for users' selections. In an exemplary embodiment, the illumination system 100 may further include a storage unit, so as to store parameters determined according to preferences or habits of users for statistic and analytic purposes. The parameters may include optical characteristics of the illumination beam IB, such as a spectrum, intensity, or a color temperature of the illumination beam IB, which should however not be construed as a limitation to the disclosure.

Prior to the step S200, the algorithm unit 120 may acquire the reflection spectrum of the object O in step S100. Several methods of acquiring the reflection spectrum of the object O are provided below, which should however not be construed as a limitation to the disclosure. The illumination system 100 provided in the present exemplary embodiment may further include an input unit 130 that inputs a color code CI of the object O, and the color code CI is, for instance, the color coordinate provided by suppliers. The input unit 130 may be a device that can merely perform the input function (e.g., a keyboard or a touch panel) or a device that can perform both the input function and the display function (e.g., a touch display panel). The algorithm unit 120 is coupled to the input unit 130 and calculates the reflection spectrum of the object O according to the color code CI.

In an exemplary embodiment, the reflection spectrum of the object O can also be acquired through a standard light source and an image acquiring device in the illumination system 100. The image acquiring device is configured to acquire the reflection spectrum of the object O while the object O is being irradiated by the standard light source. The image acquiring device can be any device suitable for acquiring the color information of the object, such as a charge coupled device (CCD) or a complementary metal oxide semiconductor (CMOS); however, the disclosure is not limited thereto. The algorithm unit 120 is coupled to the image acquiring device and acquires the reflection spectrum of the object O from the image acquiring device.

In another exemplary embodiment, the illumination system 100 may not be equipped with the standard light source, and the image acquiring device acquires a background spectrum and a spectrum reflected by the object while the object O is being irradiated by the background spectrum. The algorithm unit 120 coupled to the image acquiring device then makes a normalized calculation according to the background spectrum and the spectrum reflected by the object O while the object O is being irradiated by the background spectrum, so as to acquire the reflection spectrum of the object O.

In yet another exemplary embodiment, the reflection spectrum of the object O can also be acquired through a color chart and the image acquiring device in the illumination system 100. Particularly, the image acquiring device acquires a spectrum reflected by the object O while the object O is being irradiated by the background spectrum and a spectrum reflected by the color chart while the color chart is being irradiated by the same background spectrum. The algorithm unit 120 coupled to the image acquiring device then calculates the reflection spectrum of the object O according to the spectrum reflected by the object O and the spectrum reflected by the color chart when the same background spectrum is provided. For instance, if the spectrum reflected by the color chart while the color chart is being irradiated by the background spectrum differs from the original reflection spectrum of the color chart, the inverse matrix that can be applied to calculate the reflection spectrum of the object O is obtained by comparing the original reflection spectrum of the color chart with the spectrum reflected by the color chart when the background spectrum is provided.

To sum up, the illumination system and the method for developing target visual perception of the object are provided herein. Here, the illumination beam output by the light source device is modulated according to the reflection spectrum of the object, the visual color matching function, the visual preference correction function, or a combination thereof, such that the object develops target visual perception while the object is being irradiated by the illumination beam. In terms of commercial applications, the illumination effects created by the illumination system are conducive to boosting shopping desires and creating experiences which influence consumers' mood and behavior.

It will be apparent to those skilled in the art that various modifications and variations can be made to the structure of the disclosed exemplary embodiments without departing from the scope or spirit of the disclosure. In view of the foregoing, it is intended that the disclosure cover modifications and variations of this disclosure provided they fall within the scope of the following claims and their equivalents.

What is claimed is:

1. An illumination system, comprising:

a light source device; and an algorithm unit coupled to the light source device, the algorithm unit outputting a control signal to the light source device according to a reflection spectrum of an object, a visual color matching function, a visual preference correction function, or a combination thereof; the light source device outputting an illumination beam according to the control signal, so as to develop target visual perception of the object while the object is being irradiated by the illumination beam, wherein the visual preference correction function comprises a plurality of transformation matrices, the algorithm unit selects at least one target transformation matrix from the transformation matrices according to a visual configuration condition, and the algorithm unit outputs the control signal according to the at least one target transformation matrix, so as to modulate a spectrum of the illumination beam and accordingly correct at least one of a value, a hue, and a chroma of the object while the object is being irradiated by the illumination beam and develop the target visual perception.

2. The illumination system as recited in claim 1, wherein the light source device comprises a plurality of light emitting elements having different light emitting spectra, and the light source device modulates intensities of emitted light beams from the light emitting elements according to the control signal.

3. The illumination system as recited in claim 1, further comprising:

an input unit inputting a color code of the object, the algorithm unit being coupled to the input unit and calculating the reflection spectrum of the object according to the color code.

4. The illumination system as recited in claim 1, further comprising:

a standard light source; and an image acquiring device acquiring the reflection spectrum of the object while the object is being irradiated by the standard light source, the algorithm unit being coupled to the image acquiring device and acquiring the reflection spectrum of the object from the image acquiring device.

5. The illumination system as recited in claim 1, further comprising:

an image acquiring device acquiring a background spectrum and a spectrum reflected by the object while the object is being irradiated by the background spectrum, the algorithm unit being coupled to the image acquiring device and calculating the reflection spectrum of the object according to the background spectrum and the spectrum reflected by the object while the object is being irradiated by the background spectrum.

6. The illumination system as recited in claim 1, further comprising:

a color chart; and an image acquiring device adapted to acquire a spectrum reflected by the object while the object is being irradiated by a background spectrum and a spectrum reflected by the color chart while the color chart is being irradiated by the same background spectrum, the algorithm unit being coupled to the image acquiring device and calculating the reflection spectrum of the object according to the spectrum reflected by the object while the object is being irradiated by the background spectrum and the spectrum reflected by the color chart while the color chart is being irradiated by the same background spectrum.

7. The illumination system as recited in claim 1, wherein the visual preference correction function indicates the target visual perception, and the algorithm unit corrects the control signal according to the visual preference correction function to modulate intensity of the illumination beam, such that a value of the object is within a range from N4 to N6 defined by a Munsell Color System while the object is being irradiated by the illumination beam.

8. The illumination system as recited in claim 1, further comprising:

a storage unit storing parameters determined according to preferences or habits of users.

9. The illumination system as recited in claim 1, wherein the visual configuration condition indicates the target visual perception, each of the transformation matrices has a weighted value corresponding to the target visual perception, and a weighted value of the at least one target transformation matrix corresponding to the target visual perception is greater than 50%.

10. The illumination system as recited in claim 1, wherein the algorithm unit is installed in the light source device, a mobile device, a gateway, or a cloud system.

11. A method for developing target visual perception of an object, comprising:

outputting by an algorithm unit a control signal to a light source device according to a reflection spectrum of the object, a visual color matching function, a visual preference correction function, or a combination thereof; and outputting by the light source device an illumination beam according to the control signal, such that the object develops target visual perception while the object is being irradiated by the illumination beam, wherein the visual reference correction function comprises a plurality of transformation matrices, the algorithm unit selects at least one target transformation matrix from the transformation matrices according to a visual configuration condition, and the algorithm unit outputs the control signal according to the at least one target transformation matrix, so as to modulate a spectrum of the illumination beam and accordingly correct at least one of a value, a hue, and a chroma of the object while the object is being irradiated by the illumination beam and develop the target visual perception.

12. The method as recited in claim 11, further comprising:

storing by a storage unit parameters determined according to preferences or habits of users, the parameters comprising a spectrum, intensity, or a color temperature of the illumination beam.

13. The method as recited in claim 11, wherein the light source device comprises a plurality of light emitting elements having different light emitting spectra, and the light source device modulates intensities of emitted light beams from the light emitting elements according to the control signal.

14. The method as recited in claim 11, further comprising:

inputting a color code of the object by an input unit; and calculating by the algorithm unit the reflection spectrum of the object according to the color code, the algorithm unit being coupled to the input unit.

15. The method as recited in claim 11, further comprising:

irradiating the object by a standard light source;

acquiring by an image acquiring device the reflection spectrum of the object while the object is being irradiated by the standard light source; and acquiring by the algorithm unit the reflection spectrum of the object from the image acquiring device.

16. The method as recited in claim 11, further comprising:

acquiring by an image acquiring device a background spectrum and a spectrum reflected by the object while the object is being irradiated by the background spectrum; and calculating by the algorithm unit the reflection spectrum of the object according to the background spectrum and the spectrum reflected by the object while the object is being irradiated by the background spectrum.

17. The method as recited in claim 11, further comprising:

acquiring by an image acquiring device a spectrum reflected by the object while the object is being irradiated by a background spectrum and a spectrum reflected by a color chart while the color chart is being irradiated by the same background spectrum; and calculating by the algorithm unit the reflection spectrum of the object according to the spectrum reflected by the object while the object is being irradiated by the background spectrum and the spectrum reflected by the color chart while the color chart is being irradiated by the same background spectrum.

18. The method as recited in claim 11, wherein the visual preference correction function indicates the target visual perception, and the algorithm unit corrects the control signal according to the visual preference correction function to modulate intensity of the illumination beam, such that a value of the object is within a range from N4 to N6 defined by a Munsell Color System while the object is being irradiated by the illumination beam.

19. The method as recited in claim 11, wherein the algorithm unit transmits the control signal to the light source device through a cable or through a wireless connection.

* * * * *